US008267675B2

(12) United States Patent
Bai et al.

(10) Patent No.: US 8,267,675 B2
(45) Date of Patent: Sep. 18, 2012

(54) HIGH FLOW PIEZOELECTRIC PUMP

(75) Inventors: Shushan Bai, Ann Arbor, MI (US); John C. Schultz, Saline, MI (US); Vijay A. Neelakantan, Columbus, OH (US)

(73) Assignee: GM Global Technology Operations LLC, Detroit, MI (US)

( * ) Notice: Subject to any disclaimer, the term of this patent is extended or adjusted under 35 U.S.C. 154(b) by 1129 days.

(21) Appl. No.: 12/140,076

(22) Filed: Jun. 16, 2008

(65) Prior Publication Data

US 2009/0311116 A1 Dec. 17, 2009

(51) Int. Cl.
*F04B 17/03* (2006.01)

(52) U.S. Cl. ..... 417/413.2

(58) Field of Classification Search ..... 417/412, 417/413.1, 413.2, 481, 395
See application file for complete search history.

(56) References Cited

U.S. PATENT DOCUMENTS

| | | | | |
|---|---|---|---|---|
| 3,598,506 | A | 8/1971 | O'Neill | |
| 4,803,393 | A * | 2/1989 | Takahashi | 310/328 |
| 2006/0198740 | A1 * | 9/2006 | Yamamoto et al. | 417/395 |

FOREIGN PATENT DOCUMENTS

| | | |
|---|---|---|
| CN | 101042129 | 9/2007 |
| DE | 4407962 C1 | 6/1995 |
| GB | 2087659 | 5/1982 |

* cited by examiner

*Primary Examiner* — Devon Kramer
*Assistant Examiner* — Bryan Lettman

(57) ABSTRACT

A piezoelectric pump for pumping a fluid at a high flow rate includes a housing and an actuator located within the housing. An electric voltage applied to the actuator causes the actuator to apply a force to a first diaphragm that is proximate to the actuator. A piston assembly is located within the housing and is moveable between at least a first position and a second position. A first fluid chamber is defined by the housing, the first diaphragm, and the piston assembly. A coupling fluid is located within the first fluid chamber for coupling the first diaphragm to the piston assembly. A second fluid chamber is defined by the housing and the piston assembly. An inlet valve is in communication with the second fluid chamber and an outlet valve is in communication with the second fluid chamber.

12 Claims, 2 Drawing Sheets

HIGH FLOW PIEZOELECTRIC PUMP

FIELD

Figure 1A:
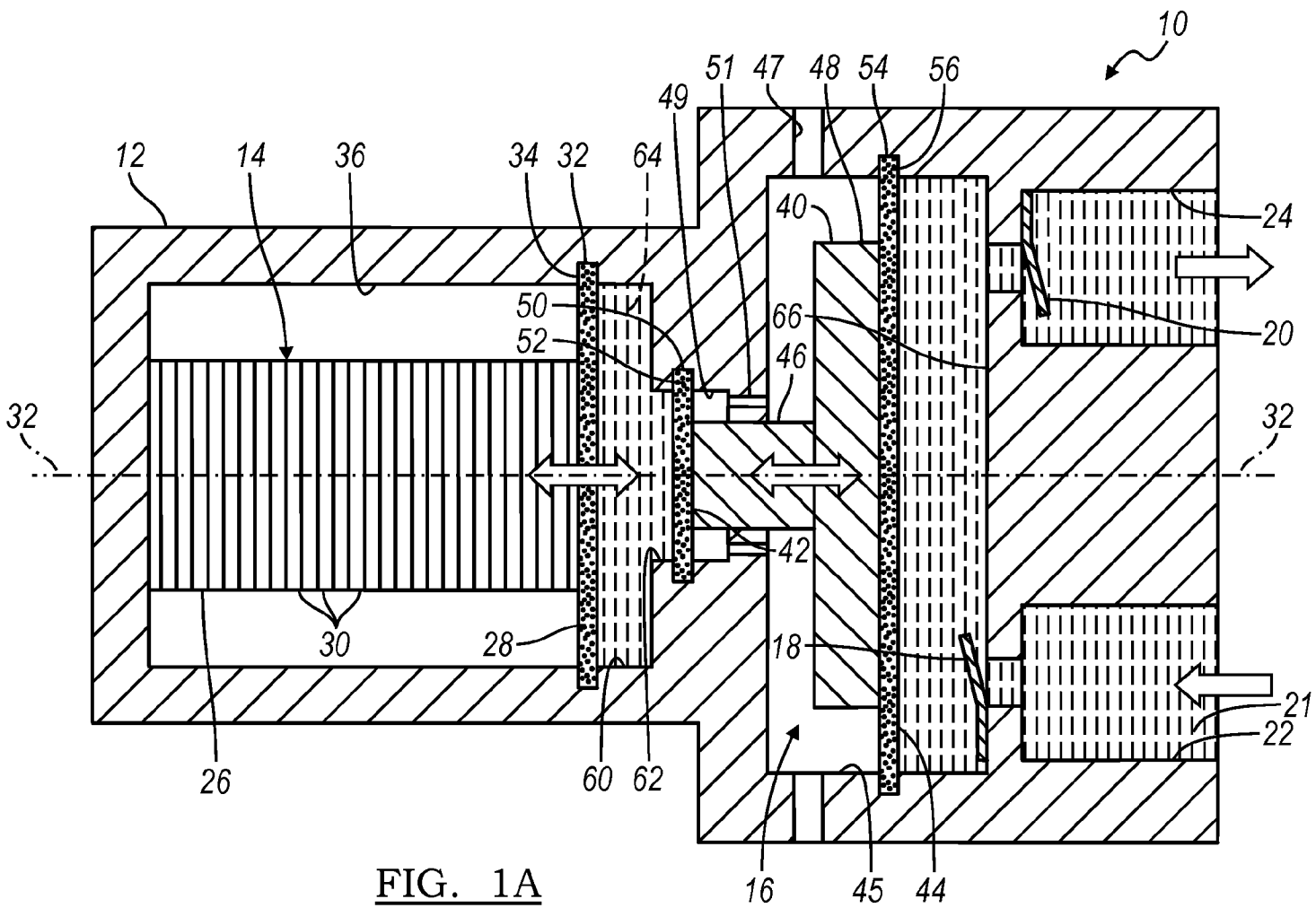

The present disclosure relates to a piezoelectric pump, and more particularly to a piezoelectric pump having a fluid coupling between a piezoelectric actuator and a piston that is capable of providing a high flow of hydraulic fluid.

BACKGROUND

The statements in this section merely provide background information related to the present disclosure and may or may not constitute prior art.

A typical piezoelectric pump includes a piezoelectric actuator stack located within a pump housing. The piezoelectric stack is composed of a piezoelectric material that, when subjected to an electric voltage, expands and contracts in shape and/or size as compared to its normal condition when no voltage is applied. The actuator stack is operable to engage a diaphragm located within a fluid chamber. The fluid chamber communicates with a one-way inlet valve and with a one-way outlet valve. When an electric voltage is applied to the actuator stack, the materials within the actuator stack expand and contract. This displacement is applied to the diaphragm within the fluid chamber. Accordingly, the displacement of the diaphragm varies the volume of the fluid chamber which draws hydraulic fluid in through the inlet valve and forces the hydraulic fluid out through the outlet valve.

These conventional piezoelectric pumps are capable of producing a strong displacement force, which provides high hydraulic pressure within the fluid chamber. However, the actual amount of displacement of the piezoelectric material within the actuator stack is limited. Accordingly, these typical piezoelectric pumps are not able to provide high hydraulic fluid flow, which in turn limits the applications suitable for piezoelectric pumps. For example, it would be desirable to employ a piezoelectric pump within a transmission hydraulic control system in order to provide pressurized hydraulic fluid flow when the engine is turned off. This application may be especially desirable in hybrid powertrains. However, conventional piezoelectric pumps are not capable of providing the high fluid flow required by transmission hydraulic control systems. Accordingly, there is a need in the art for a piezoelectric pump that is operable to provide a high flow of hydraulic fluid.

SUMMARY

The present invention provides a piezoelectric pump for pumping a fluid at a high flow rate. The piezoelectric pump includes a housing and an actuator located within the housing. An electric voltage applied to the actuator causes the actuator to apply a force to a first diaphragm that is proximate to the actuator. A piston assembly is located within the housing and is moveable between at least a first position and a second position. A first fluid chamber is defined by the housing, the first diaphragm, and the piston assembly. A coupling fluid is located within the first fluid chamber for coupling the first diaphragm to the piston assembly. A second fluid chamber is defined by the housing and the piston assembly. An inlet valve is in communication with the second fluid chamber and an outlet valve is in communication with the second fluid chamber. The force applied by the actuator displaces the first diaphragm forcing the coupling fluid to move the piston assembly from the first position to the second position, and the movement of the piston assembly between the first position and the second position changes a volume of the second fluid chamber thereby moving the fluid into the second fluid chamber through the inlet valve and out of the second fluid chamber through the outlet valve.

In one aspect of the present invention, the piston assembly comprises a second diaphragm and the first sealed portion is at least partially defined by the second diaphragm of the piston assembly.

In another aspect of the present invention, the piston assembly comprises a third diaphragm and the second sealed portion is at least partially defined by the third diaphragm of the piston assembly.

In yet another aspect of the present invention, the first diaphragm has a surface area greater than a surface area of the second diaphragm, and wherein the third diaphragm has a surface area greater than the surface area of the first diaphragm.

In yet another aspect of the present invention, the first, second, and third diaphragms are attached to the housing and are flexible.

In yet another aspect of the present invention, the piston assembly moves along a linear axis between the first position and the second position.

In yet another aspect of the present invention, the first fluid chamber is sealed.

In yet another aspect of the present invention, the first fluid chamber has a neck portion along the linear axis, the neck portion having a reduced cross-sectional area such that the coupling fluid within the first fluid chamber is forced into the neck portion by the displacement of the first diaphragm, thereby amplifying the displacement of the piston assembly along the linear axis.

In yet another aspect of the present invention, the actuator comprises at least one piezoelectric material that deforms when an electric voltage is applied to the piezoelectric material.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 1B:
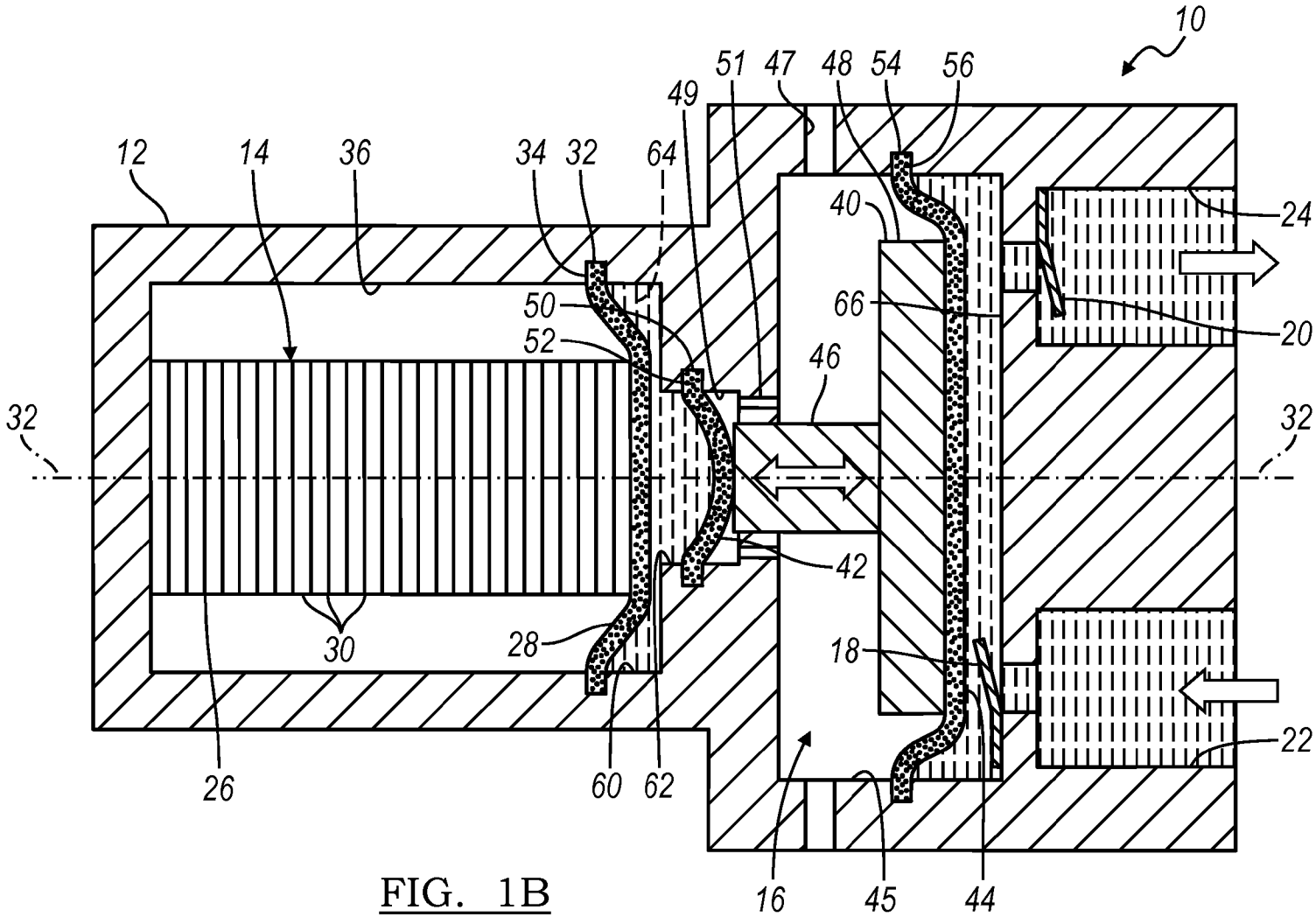

FIG. 1A is a cross-sectional view of a piezoelectric pump according to the principles of the present invention in a first position; and FIG. 1B is a cross-sectional view of a piezoelectric pump according to the principles of the present invention in a second position.

DETAILED DESCRIPTION

The following description is merely exemplary in nature and is not intended to limit the present disclosure, application, or uses.

With reference to FIG. 1, a piezoelectric pump according to the principles of the present invention is generally indicated by reference number 10. The pump 10 generally includes a pump housing 12, an actuator assembly 14, a piston assembly 16, an inlet valve 18, and an outlet valve 20. The pump 10 is operable to pump a substance, such as a hydraulic fluid 21, through an inlet port 22 located in the housing 12 to an outlet port 24 located in the housing 12, as will be described in greater detail below.

The actuator assembly 14 is located within the housing 12 and includes an actuator stack 26 that is in at least partial contact with a first diaphragm 28. The actuator stack 26 is comprised of a plurality of stacked piezoelectric material layers 30. The piezoelectric material layers 30 are comprised of a piezoelectric material that is operable to expand and contract (i.e., produce a strain output or deformation) when a suitable electric voltage is applied to the actuator stack 26. In the preferred embodiment, the piezoelectric material layers 30 expand and contract in a direction at least partially along a linear axis 32. Examples of piezoelectric materials include, but are not limited to, quartz crystals, lead niobate barium titanate, and other titante compounds such as lead zirconate titante. However, it should be appreciated that the actuator stack 26 may take various forms without departing from the scope of the present invention, for example, the actuator stack 26 may include a single layer of piezoelectric material or other configurations other than or in addition to stacked layers of piezoelectric materials.

The first diaphragm 28 is preferably disc shaped and fixedly attached to the housing 12 along an outer edge 32 of the first diaphragm 28. More specifically, the outer edge 32 is sealed within a groove 34 formed in an inner surface 36 of the housing 12. However, various other methods of securing the first diaphragm 28 to the housing 12 may be employed without departing from the scope of the present invention. In addition, it should be appreciated that the first diaphragm 28 may take various other shapes without departing from the scope of the present invention. The first diaphragm 28 is comprised of a flexible but resilient material. The first diaphragm 28 is operable to be deformed or flexed by the movement of the actuator stack 26, as will be described in greater detail below.

The piston assembly 16 includes a piston 40, a second diaphragm 42, and a third diaphragm 44. The piston 40 is slidably disposed within a first chamber 45 of the housing 12. The first chamber 45 includes vents 47 for allowing air to enter and leave the chamber 45. The piston 40 includes a piston shaft 46 extending from a piston head 48. The piston shaft 46 extends into a second chamber 49 that is defined by the housing 12 and the second diaphragm 42. The second chamber 49 is in communication with the first chamber 45 via vents 51. The piston 40 is slidably moveable along the linear axis 32 between a first position, as shown in FIG. 1A, and a second position, as shown in FIG. 1B.

The second diaphragm 42 is preferably disc shaped and fixedly attached to the housing 12 along an outer edge 50 of the second diaphragm 42. More specifically, the outer edge 50 is sealed within a groove 52 formed in the inner surface 36 of the housing 12. However, various other methods of securing the second diaphragm 42 to the housing 12 may be employed without departing from the scope of the present invention. In addition, it should be appreciated that the second diaphragm 42 may take various other shapes without departing from the scope of the present invention. The second diaphragm 42 is comprised of a flexible but resilient material. The second diaphragm 42 is operable to be deformed or flexed by the movement of the actuator stack 26, as will be described in greater detail below. The second diaphragm 42 has a surface area less than a surface area of the first diaphragm 28.

The third diaphragm 44 is similar to the second diaphragm 42 and is preferably disc shaped and fixedly attached to the housing 12 along an outer edge 54 thereof. More specifically, the outer edge 54 is sealed within a groove 56 formed in the inner surface 36 of the housing 12. However, various other methods of securing the third diaphragm 44 to the housing 12 may be employed without departing from the scope of the present invention. In addition, it should be appreciated that the third diaphragm 44 may take various other shapes without departing from the scope of the present invention. The third diaphragm 44 is comprised of a flexible but resilient material. The third diaphragm 44 is operable to be deformed by the movement of the piston 40, as will be described in greater detail below. The third diaphragm 44 has a surface area larger than both the surface area of the second diaphragm 42 and the surface area of the first diaphragm 28.

The pump 10 further includes a sealed fluid chamber 60 located between the actuator assembly 14 and the piston assembly 16. The sealed fluid chamber 60 is defined by the first diaphragm 28, the inner surface 36 of the housing 12, and by the second diaphragm 42. The sealed fluid chamber 60 includes a neck portion 62 having a reduced cross-sectional area. The neck portion 62 is located proximate the second diaphragm 42 and extends along the longitudinal axis 32. A coupling fluid 64 is located within the sealed fluid chamber 60. The coupling fluid 64 is preferably an oil, though various other fluids may be employed. In the preferred embodiment, the coupling fluid 64 completely fills the sealed fluid chamber 60.

The pump 10 also includes a fluid chamber 66 defined by the inner surface 36 of the housing 12 and by the third diaphragm 44. The fluid chamber 66 is in communication with the inlet port 22 via the inlet valve 18 and is in communication with the outlet port 24 via the outlet valve 20.

The inlet valve 18 is operable to allow flow of a fluid from the inlet port 22 into the fluid chamber 66 and operable to prevent fluid flow from the fluid chamber 66 into the inlet port 22. Accordingly, the inlet valve 18 is a one-way flow valve. In the example provided, the inlet valve 18 is illustrated schematically as a one-way leaf valve, however, it should be appreciated that the inlet valve 18 may take various forms including, but not limited to, a check valve, reed valve, or a solenoid activated valve.

The outlet valve 20 is operable to allow flow of a fluid from the fluid chamber 66 into the outlet port 24 and operable to prevent fluid flow from the outlet port 24 into the fluid chamber 66. Accordingly, the outlet valve 20 is a one-way flow valve. In the example provided, the outlet valve 20 is illustrated schematically as a one-way leaf valve, however, it should be appreciated that the outlet valve 20 may take various forms including, but not limited to, a check valve, reed valve, or a solenoid activated valve.

With combined reference to FIGS. 1A and 1B, the operation of the pump 10 will now be described in detail. Upon application of a suitable electric voltage to the actuator stack 26, the actuator stack 26 deforms or expands at least partially in the direction of the longitudinal axis 32. The actuator stack 26 contacts the first diaphragm 28 and flexes the first diaphragm 28 into the sealed fluid chamber 60. The movement of the first diaphragm 28 into the sealed fluid chamber 60 forces the relatively uncompressible fluid 64 to move into the neck portion 62 and act against the second diaphragm 42. Accordingly, the neck portion 62 helps increase the amount of displacement of the second diaphragm 42 by forcing more of the fluid 64 along the longitudinal axis 32. As the fluid 64 engages the second diaphragm 42, the second diaphragm 42 flexes outward along the longitudinal axis 32 and contacts the piston shaft 46 of the piston 40. The second diaphragm 42 moves the piston 40 from the first position, shown in FIG. 1A, to the second position, shown in FIG. 1B. As the piston 40 moves to the second position, the piston head 48 contacts the third diaphragm 44 and flexes the third diaphragm 44 outward along the longitudinal axis 32. The out flexing of the third diaphragm 44 decreases the volume of the fluid chamber 66 and accordingly hydraulic fluid is forced out of the fluid chamber 66, through the outlet valve 20, and out through the outlet port 24.

When the electric voltage to the actuator stack 26 is changed (either via removing the electric voltage or changing the electric voltage to initiate a contraction), the actuator stack 26 contracts either to its original condition or to a contracted condition. This in turn allows the first, second, and third diaphragms 28, 42, 44 to return to their unflexed normal positions, as shown in FIG. 1A. As the third diaphragm 44 returns to its normal condition, the volume of the fluid chamber 66 increases, and hydraulic fluid is drawn into the vacuum through the inlet valve 18 and the inlet port 22. By alternatively cycling the electric voltage applied to the actuator stack 26, fluid may be drawn into the fluid chamber 66 and forced out repeatedly. By coupling the movement of the actuator stack 26 to the piston assembly 16 via the coupling fluid 64, a multiplication of displacement distance along the longitudinal axis 32 is achieved. This in turn allows for an increased change in volume within the fluid chamber 66 and therefore an increased amount of fluid flow drawn into the fluid chamber 66 and forced out of the fluid chamber 66.

In an alternate embodiment of the present invention, the second diaphragm 42 and the third diaphragm 44 are removed and the piston head 48 and the piston shaft 46 are directly sealed to the inner surface 36 of the housing 12. In this embodiment, the coupling fluid 64 acts directly on the piston shaft 46 and moves the piston shaft 46 between the first and second positions. Likewise, the piston head 48 directly communicates with the fluid chamber 66 and alters the volume thereof.

The description of the invention is merely exemplary in nature and variations that do not depart from the gist of the invention are intended to be within the scope of the invention. Such variations are not to be regarded as a departure from the spirit and scope of the invention.

We claim the following:

1. A piezoelectric pump for pumping a fluid, the pump comprising:

a housing;

an actuator located within the housing, wherein an electric voltage applied to the actuator causes the actuator to apply a force;

a first diaphragm proximate to the actuator;

a second diaphragm proximate to the first diaphragm;

a piston assembly located within the housing, the piston assembly moveable between at least a first position and a second position;

a first fluid chamber defined by the housing, the first diaphragm, and the second diaphragm, and wherein the first fluid chamber is sealed from communicating with the piston assembly;

a coupling fluid located within the first fluid chamber for coupling the first diaphragm to the second diaphragm;

a second fluid chamber defined by the housing and the piston assembly;

an inlet valve in communication with the second fluid chamber;

an outlet valve in communication with the second fluid chamber;

wherein the force applied by the actuator displaces the first diaphragm forcing the coupling fluid to move the second diaphragm and the piston assembly from the first position to the second position, and wherein movement of the piston assembly between the first position and the second position changes a volume of the second fluid chamber thereby moving the fluid into the second fluid chamber through the inlet valve and out of the second fluid chamber through the outlet valve.

2. The piezoelectric pump of claim 1 wherein the piston assembly comprises a piston in contact with a third diaphragm, and the second fluid chamber is at least partially defined by the third diaphragm of the piston assembly.

3. The piezoelectric pump of claim 2 wherein the first diaphragm has a surface area greater than a surface area of the second diaphragm, and wherein the third diaphragm has a surface area greater than the surface area of the first diaphragm.

4. The piezoelectric pump of claim 2 wherein the first, second, and third diaphragms are attached to the housing and are flexible.

5. The piezoelectric pump of claim 1 wherein the piston assembly moves along a linear axis between the first position and the second position.

6. The piezoelectric pump of claim 5 wherein the first fluid chamber has a neck portion along the linear axis, the neck portion having a reduced cross-sectional area such that the coupling fluid within the first fluid chamber is forced into the neck portion by the displacement of the first diaphragm, thereby amplifying the displacement of the piston assembly along the linear axis.

7. The piezoelectric pump of claim 1 wherein the actuator comprises at least one piezoelectric material that deforms when the electric voltage is applied to the piezoelectric material.

8. A piezoelectric pump for pumping a fluid, the pump comprising:

a housing;

an actuator located within the housing, wherein an electric voltage applied to the actuator causes the actuator to apply a force;

a first diaphragm proximate to the actuator;

a second diaphragm proximate the first diaphragm;

a third diaphragm proximate the second diaphragm;

a piston located between the second and third diaphragms, the piston moveable between at least a first position and a second position;

a first fluid chamber defined by the housing, the first diaphragm, and the second diaphragm, and wherein the first fluid chamber is sealed from the piston;

a coupling fluid located within the first fluid chamber for coupling the first diaphragm to the second diaphragm;

a second fluid chamber defined by the housing and the third diaphragm;

an inlet valve in communication with the second fluid chamber;

an outlet valve in communication with the second fluid chamber;

wherein the force applied by the actuator displaces the first diaphragm forcing the coupling fluid to displace the second diaphragm, wherein displacement of the second diaphragm moves the piston from the first position to the second position, and wherein movement of the piston between the first position and the second position displaces the third diaphragm thereby changing a volume of the second fluid chamber.

9. The piezoelectric pump of claim 8 wherein the first, second, and third diaphragms are attached to the housing and are flexible.

10. The piezoelectric pump of claim 9 wherein the piston moves along a linear axis between the first position and the second position.

11. The piezoelectric pump of claim 10 wherein the first fluid chamber has a neck portion along the linear axis, the neck portion having a reduced cross-sectional area such that the coupling fluid within the first fluid chamber is forced into the neck portion by the displacement of the first diaphragm, thereby amplifying the displacement of the second diaphragm.

12. The piezoelectric pump of claim 11 wherein the actuator comprises at least one piezoelectric material that deforms when an electric voltage is applied to the piezoelectric material.

* * * * *